United States Patent [19]

Welch

[11] 3,980,006

[45] Sept. 14, 1976

[54] CONTINUOUS ENVELOPE SYSTEM

[75] Inventor: Archibald H. Welch, Branford, Conn.

[73] Assignee: Converters Incorporated, Farmington, Conn.

[22] Filed: Apr. 7, 1975

[21] Appl. No.: 565,552

[52] U.S. Cl. ..... 93/61 R; 221/73

[51] Int. Cl.[2] ..... B31B 1/08

[58] Field of Search ..... 221/74, 73, 72, 71, 221/70; 229/69; 93/61 R, 63 M, 63 R, 62

[56] References Cited

UNITED STATES PATENTS

| | | | |
|---|---|---|---|
| 3,273,784 | 9/1966 | Porter | 229/69 |
| 3,373,989 | 3/1968 | LeBaron | 229/69 UX |
| 3,450,307 | 6/1969 | Sutton | 221/74 |
| 3,554,447 | 1/1971 | Sebring | 229/69 |
| 3,758,025 | 9/1973 | Schafer | 229/69 |

*Primary Examiner*—James F. Coan

*Attorney, Agent, or Firm*—Prutzman, Hayes, Kalb & Chilton

[57] ABSTRACT

A continuous envelope system for attaching generally conventional paper envelopes to a paper carrier sheet with spots of adhesive adjacent the outer edge of the envelope sealing flap and adjacent the upper edge of the envelope back panel and employing a detacher for subsequently detaching the envelopes from the paper carrier sheet as they are conveyed through the detacher by gradually separating the carrier sheet from the envelopes to form connecting tears therebetween and by severing the connecting tears at the envelopes with the teeth of a severance blade to detach the envelopes without forming unacceptable blemishes thereon.

16 Claims, 7 Drawing Figures

CONTINUOUS ENVELOPE SYSTEM

BRIEF SUMMARY OF THE INVENTION

The present invention relates to a continuous envelope system useful in the conveyance of envelopes and the like in succession, as for example through automatic printing and/or tabulating equipment, for automatically processing the envelopes in a desired manner.

Information storage devices and high-speed printers capable of translating the stored information into printed form have become useful and economical tools for the automatic printing of envelopes, for example for automatic addressing and/or tabulating purposes. Such automatic printing conventionally requires individual and successive feeding of the envelopes through the printer preferably at a high rate of speed for maximum economy of equipment and operator time. For this reason, a carrier sheet to which the envelopes are attached to form a composite envelope and carrier sheet product has been found useful in the conveying of the envelopes through the printer. For example, a type of composite envelope and carrier sheet product heretofore used for the automatic addressing of envelopes is disclosed in U.S. Pat. No. 3,273,784 of Virgil V. Porter dated Sept. 20, 1966 and entitled "Envelope Assemblies" and in U.S. Pat. No. 3,554,447 of John P. Sebring dated Jan. 12, 1971 and entitled "Continuous Envelopes."

It is a principal aim of the present invention to provide a new and improved continuous envelope system of the type employing an interim composite envelope and carirer sheet product for processing envelopes which is useful with envelopes of generally conventional construction and wherein the envelopes are free of any objectional blemishes after removal from the carrier sheet.

It is another aim of the present invention to provide a new and improved continuous envelope system for the attachment of sheet paper articles, such as envelopes, to a paper carrier sheet to provide an interim composite product for sequentially feeding the sheet paper articles through processing equipment, and for the subsequent detachment of the sheet paper articles from the carrier sheet for mailing, filing or other purposes, and which is specially adapted for high speed attachment and removal of the sheet paper articles, which provides a composite product useful in the printing of the sheet paper articles with presently available machines, and which has notable utility in the attachment and removal of envelopes and other sheet paper articles of conventional construction.

It is a further aim of the present invention to provide a method for attaching paper envelopes or other flat paper articles onto and removing them from a paper carrier sheet without unacceptable blemishes marring the quality or appearance of the paper articles.

It is another aim of the present invention to provide a new and improved continuous envelope system of the type described employing a new and improved method and apparatus for detaching the paper articles from the supporting paper carrier sheet without objectionable scarring of the paper articles.

It is a further aim of the present invention to provide new and improved envelope detaching apparatus of economical and compact construction, useful by the unskilled, and adapted for intermittent or substantially continuous operation.

It is a still further aim of the present invention to provide a new and improved envelope attaching and detaching method for temporarily securing and removing envelopes from a carrier sheet.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Several developoments have been employed for the application of envelopes to a carrier web. One such development disclosed in U.S. Pat. No. 2,723,077, dated Nov. 8, 1955 and entitled "Continuous Envelopes," consists of a pair of supplemental end flaps formed integrally with the envelope panels for attaching the envelopes to the carrier web and having suitable lines of perforations for faciliating subsequent severance of the envelope panels from the carrier web. Another such development disclosed in U.S. Pat. No. 2,691,327, dated Oct. 12, 1954 and entitled "Envelope Assembling Apparatus," provides for forming a series of loops on a pair of spaced carrier tapes and for inserting the ends of the envelopes under these loops for attachment of the envelopes to the tapes. A third such development is disclosed in U.S. Pat. No. 2,363,417, dated Nov. 21, 1944 and entitled "Method of and Apparatus for Making Zig-Zag Folded Assemblies of Series-Connected Envelopes." This development provides for applying an even coating of adhesive to the front face of the envelope and thereby attach the envelope to the carrier web. For subsequently detaching the envelope, the carrier web is provided with suitable severance lines for separating that portion of the carrier web adhering to the front face of the envelope and which thereafter remains a part of the detached envelope. A fourth such development disclosed in the aforementioned U.S. Pat. Nos. 3,273,784 and 3,554,447, provides for attaching envelopes to a carrier web with spots of adhesive. And in its preferred form, the present invention employs spots of adhesive for securing the envelopes to a carrier sheet to provide a new and improved continuous envelope system for attaching and detaching the envelopes from a carrier sheet.

Figure 1:
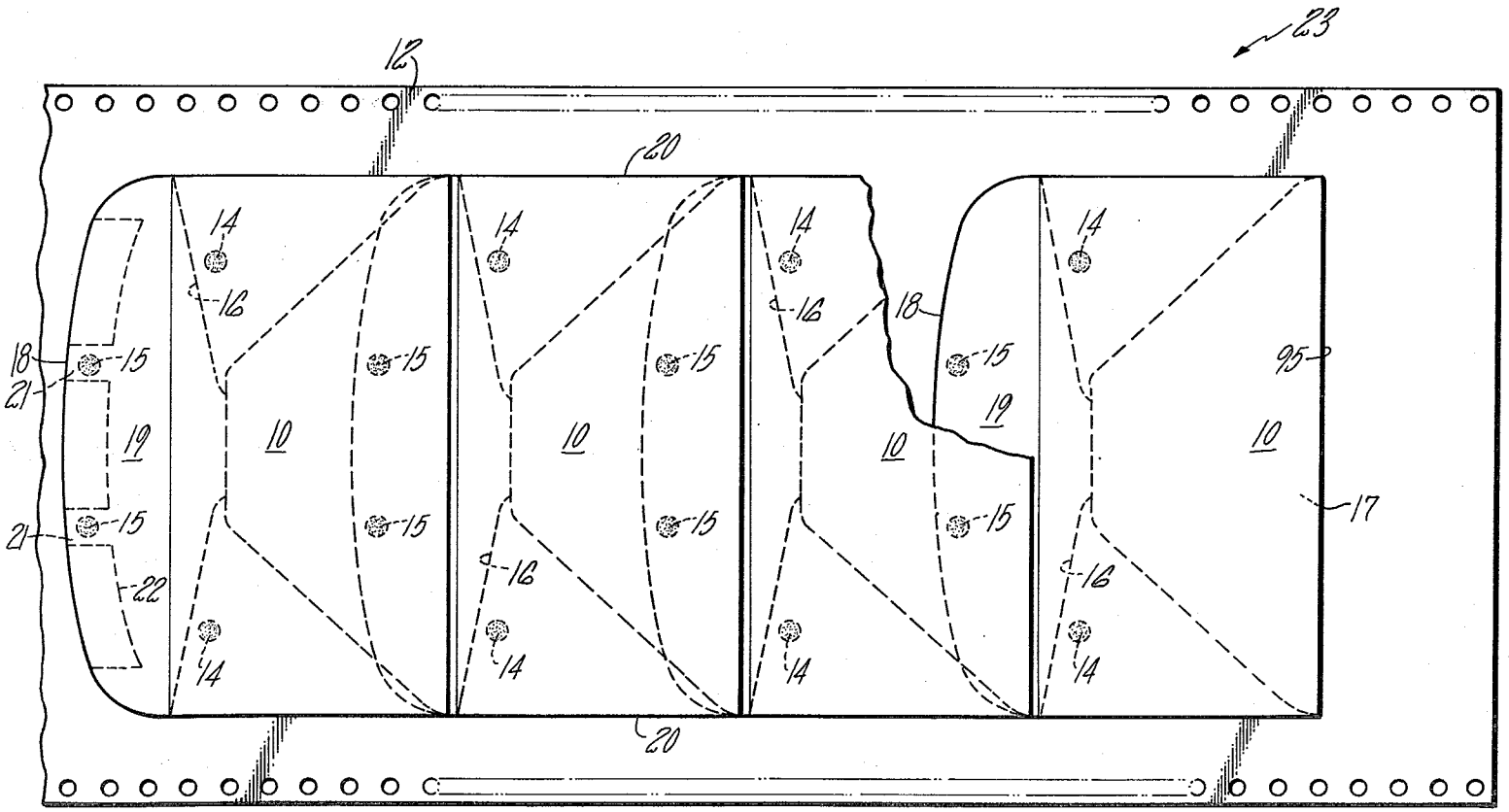
FIG. 1 is a fragmentary plan view, partly broken away, of an embodiment of a composite envelope and carrier sheet product employed in the continuous envelope system of the present invention.

The attachment of substantially standard or conventional paper envelopes 10 to a paper carrier sheet 12 is accomplished by conveying the envelopes in sequence onto a moving paper carrier sheet 12 as disclosed and described in detail in my U.S. Pat. No. 3,383,264, dated May 14, 1968 and entitled "Method and Apparatus For Attaching and Removing Envelopes and the Like From A Carrier Web." As described in my U.S. Pat. No. 3,383,264, the paper envelopes are conveyed by a conveyor along an elongated horizontal path with the body of each envelope extending transversely of its direction of movement and with its back panel down and its sealing flap at the trailing edge of the envelope. The envelopes are individually conveyed into engagement with the moving carrier sheet 12 to provide an evenly spaced succession of envelopes on the carrier sheet, each with its sealing flap open and extending beneath the body of the succeeding envelope as shown in FIG. 1. Immediately before each envelope 10 is conveyed into engagement with the moving carrier sheet 12, suitable adhesive applying apparatus is effective in applying adhesive to predetermined areas on the underside of each envelope or on the upper face of the carrier sheet 12. The envelope 10 is then conveyed with the carrier sheet 12 through a sealing station where each envelope is securely adhered to the carrier sheet with the previously applied adhesive to form a composite envelope and carrier sheet product of the type generally referred to as a continuous envelope and useful in the automated processing of the envelopes.

In accordance with the preferred form of the continuous envelope system of the present invention, the envelopes 10 are of substantially standard or conventional construction and the adhesive is applied so that each envelope 10 is attached to the carrier sheet 12 by a pair of laterally spaced attachment spots 14 adjacent the upper lateral edge 16 of the envelope back panel 17 and by a pair of laterally spaced attachment spots 15 adjacent the outer edge 18 of the sealing flap 19. Thus, each spot attachment 14, 15 is adjacent a trailing edge 16, 18 of the respective sheet portion of the envelope. Preferably, the two attachment spots 15 are provided adjacent the outer sealing flap edge 18 substantially inwardly of and symmetrically relative to the lateral edges 20 of the envelope (and as shown in FIG. 1, gaps 21 are preferably provided in each seal flap glue line 22 to accommodate the attachment spots 15, or alternatively, attachment could be made to the glue line or inside of the glue line), and the two attachment spots 14 are provided substantially inwardly of and also symmetrically relative to the lateral edges 20 of the envelope 10. The sealing flap attachment spots 15 may be located in lateral alignment with the back panel attachment spots 14 but are preferably located inwardly thereof as shown in FIG. 1.

With the envelopes 10 thereby attached to the carrier sheet 12, the resulting composite envelope and carrier sheet product 23 can be suitably folded in zig-zag or accordian fashion as described in my aforementioned U.S. Pat. No. 3,383,264 for facilitating handling the composite envelope and carrier sheet product 23.

After the envelopes 10 have been processed as desired, the envelopes are adapted to be successively and individually detached from the carrier sheet 12 in accordance with the continuous envelope system of the present invention by a detacher, denoted generally by the numeral 30, through which the composite envelope and carrier sheet product 23 is longitudinally forwardly fed, from left to right as seen in FIGS. 2–7. The detacher 30 is driven by a suitable variable speed motor 31 through reduction gearing 32 as shown diagrammatically in FIG. 2, or alternatively, as where small quantities of envelopes are intermittently processed by a suitable manually operable crank (not shown).

The detacher 30 includes a pair of laterally spaced and rearwardly projecting entry tracks 36, 37 having forward reduced end portions 38, 39 mounted on a transverse bar 40 and inner parallel, longitudinally extending edges 43, 44 respectively. The inner edges 43, 44 have a lateral spacing which is preferably just slightly greater than the maximum lateral spacing of the envelope attachment spots 14, 15 to provide lateral guides for guiding the composite envelope and carrier sheet product. The entry tracks 36, 37 have upper and lower coplanar surfaces and are formed of relatively thin sheet metal so they can be readily inserted between the edge portions of the composite envelope and carrier sheet product 23, with the ends of the envelopes 10 lying above the entry tracks 36, 37 and with the carrier sheet 12 lying below the entry tracks 36, 37. If desired, the entry tracks 36, 37 may be mounted so as to be laterally adjustable on the transverse bar 40 (for example by the provision of transverse slots 45, 46 for the guide mounting screws 47 as shown in broken lines in FIG. 2) whereby the entry guides 36, 37 can be laterally adjusted to position their inner lateral edges 43, 44 in accordance with the width of the envelopes 10 and the lateral spacing of the envelope attachment spots 14, 15.

For inserting the composite envelope and carrier web product 23 into the detacher 30, the composite product 23 is first manually threaded along the entry tracks 36, 37 (with the envelopes 10 and carrier sheet 12 on opposite sides of the tracks 36, 37 as described) and then the carrier sheet is manually threaded beneath the transverse bar 40 and between an elongated drive roll 50 and a pair of laterally spaced, but centrally located, narrow backup rolls 52. The drive roll 50 is rotatably mounted in upstanding stanchions 53 of a detacher frame 54, and the rolls 50, 52 have outer annular layers 55, 56 respectively of resilient material, such as rubber, whereby the carrier sheet 12 and envelopes 10 are suitably clamped between the drive and backup rolls 50, 51 for being forwardly fed thereby, from left to right as viewed in FIGS. 2 and 3. The drive roll 50 is driven by the electrical motor 31 and via the reduction gearing 32 and so that after the composite envelope and carrier sheet product 23 is properly threaded through the detacher 30, the motor 31 may be energized for feeding the composite envelope and carrier sheet product 23 through the detacher to individually detach the envelopes 10 as hereinafter described, and collect the detached envelopes in a forward envelope catcher or collector 57. For that purpose, the envelope catcher 57 has forwardly longitudinally extending lower and upper bars 58, 59 respectively for collecting the envelopes emerging from between the feed rolls 50, 52.

The backup rolls 52 are rotatably mounted and suitably axially retained on a fixed shaft 60 having end supports 61 with mounting levers 62. The pair of upper bars 59 of the envelope catcher 57 are pivotally mounted on the fixed backup roll support shaft 60 for retaining the detached envelopes within the catcher 57 and incline downwardly from their support shaft 60 and are made sufficiently light to be pivoted upwardly by the envelopes 10 as they emerge from the feed rolls 50, 52 for being stacked in the catcher 57. The lower envelope support bars 58 of the catcher 57 are mounted on a forward transverse bar 64 of the detacher frame 54 to extend forwardly from the drive roll 50 to catch and support the detached envelopes.

Upper and lower sheet metal entry guides 70, 72 respectively are provided for assisting in threading and/or guiding the envelopes 10 and carrier sheet 12 through the detacher to the throat 74 of the engaging feed rolls 50, 52. The lower sheet metal entry guide 72 is suitably mounted on the stanchions 53 to provide a smooth, slightly concave guide surface facilitating threading the leading end of the carrier sheet 12 to the throat 74 and then between the feed rolls 50, 52.

The upper sheet metal guide 70 is mounted on an upper transverse bar 78 of the frame 54 located above the transverse bar 40. The upper transverse bar 78, upper shaft supports levers 62, and the transverse bar 40 are mounted on a pair of laterally spaced upstanding threaded fasteners or studs 79 and secured in the desired vertical position with suitable lock nuts 83. The upper transverse bar 78 and levers 62 are adjusted on the support fasteners 79 to position the backup rolls 52 for proper engagement with the lower drive roll 50. The transverse bar 40 is adjusted on the support fasteners 79 to position its upper envelope guide surface 93 relative to the throat 74 of the feed rolls 50, 52.

The upper guide 70 comprises a central generally U-shaped sheet metal guide member 80 having an integral mounting clamp portion 82 for mounting the guide member 80 on the transverse bar 78 and a lower slightly concave guide portion 84 extending from a point rearwardly of the transverse bar 40 to substantially the throat 74 of the feed rolls 50, 52. The upper guide 70 also comprises a pair of separate laterally spaced rear sheet metal guide members 86 with forward clamping portions 88 for clamping the guide members 86 on the U-shaped guide member 80 and a pair of separate laterally spaced forward sheet metal guide members 89 having rear clamping portions 90 (FIG. 2) for clamping them to the transverse bar 40. The rear guide members 86 have substantially flat, guide portions 91 which are slightly downwardly inclined forwardly toward the concave guide portion 84. The guide portions 91, 84 collectively assist in guiding the leading edge of each envelope around the transverse bar 40 and to the throat 74 of the feed rolls 50, 52. The forward guide members 89 assist in guiding the carrier sheet 12 and envelopes 10 through the feed rolls 50, 52.

Figure 2:
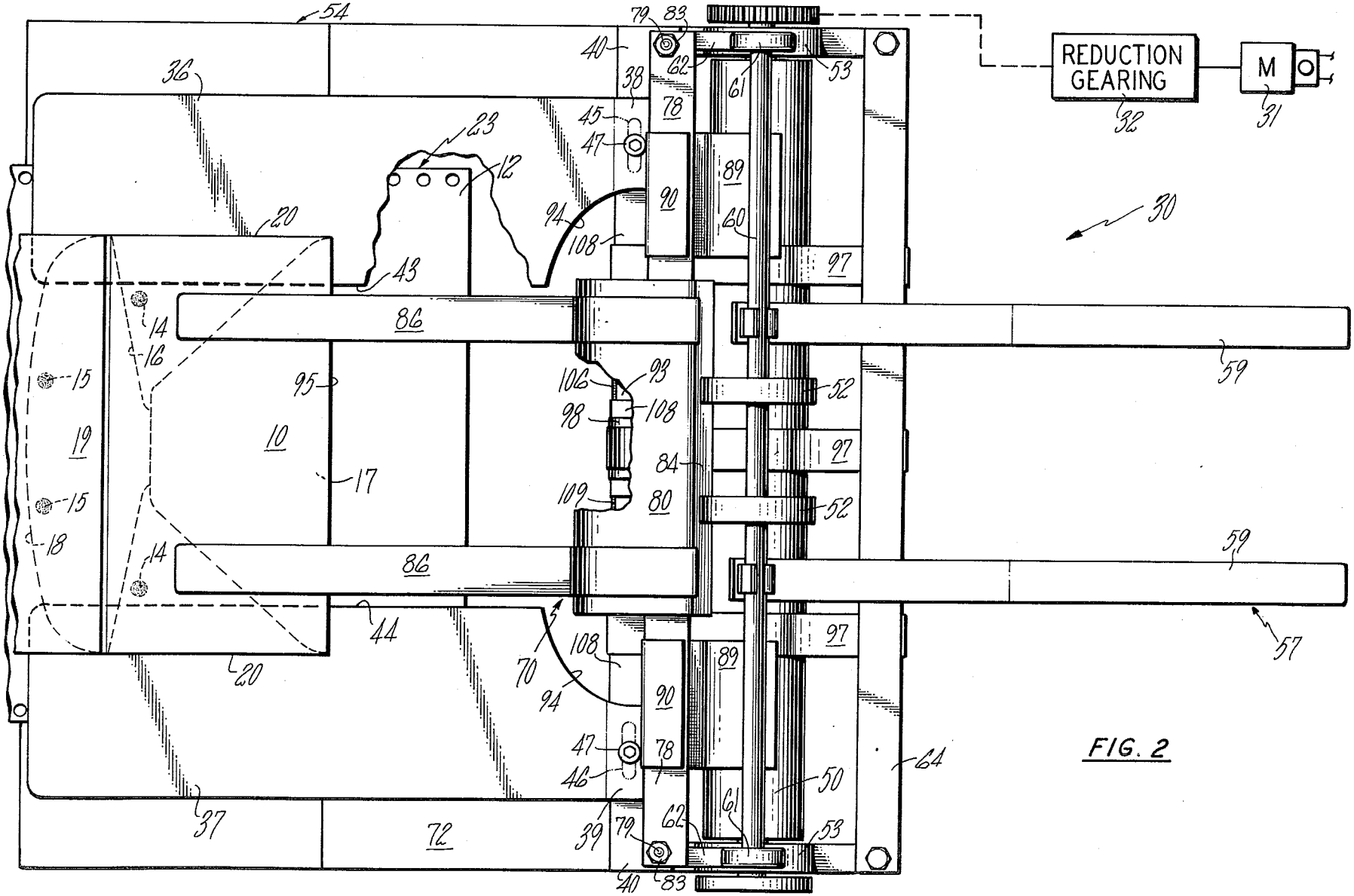
FIG. 2 is a top plan view, partly broken away, of a detacher used in the continuous envelope system for detaching envelopes from a composite envelope and carrier sheet in accordance with the present invention.
Figure 3:
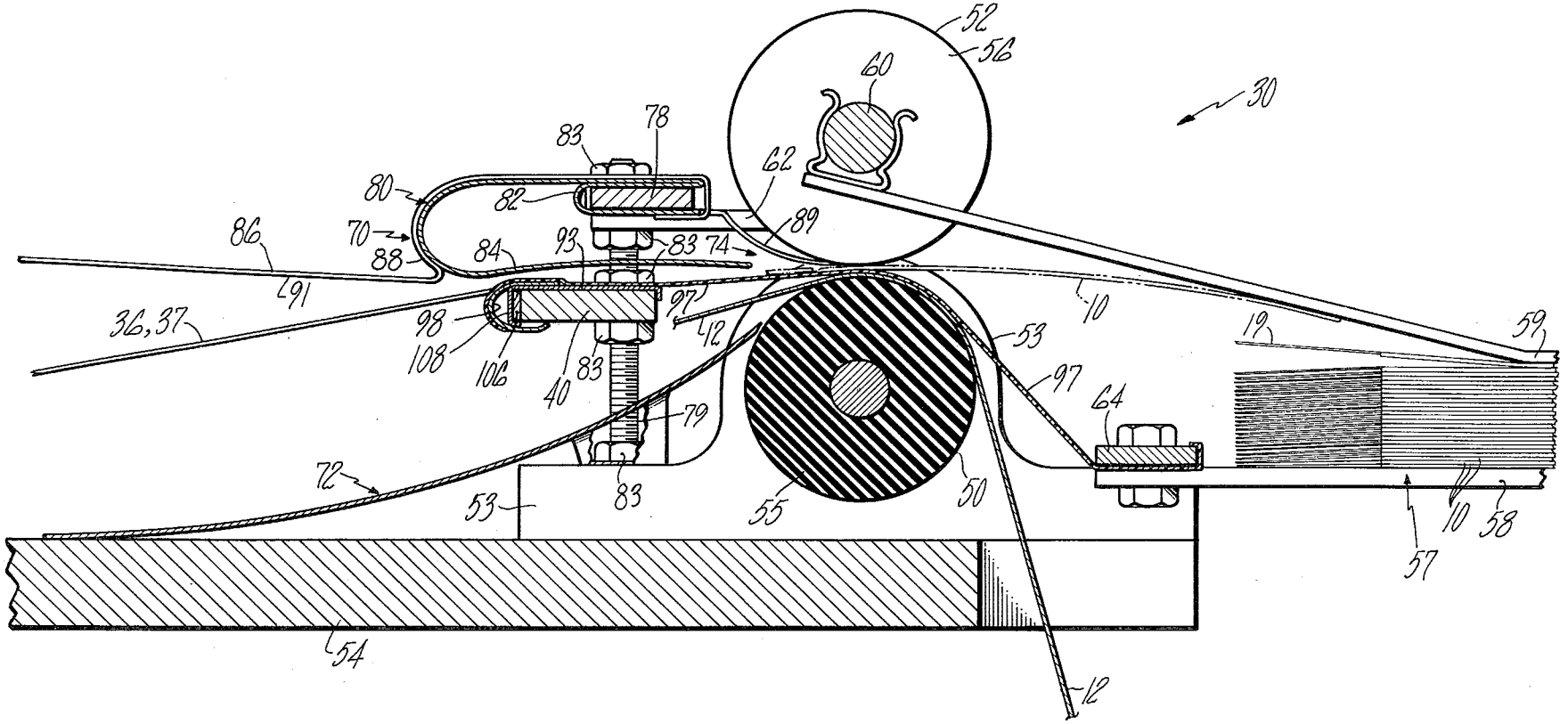
FIG. 3 is an enlarged partial longitudinal section view, partly broken away and partly in section, of the detacher.
Figure 4:
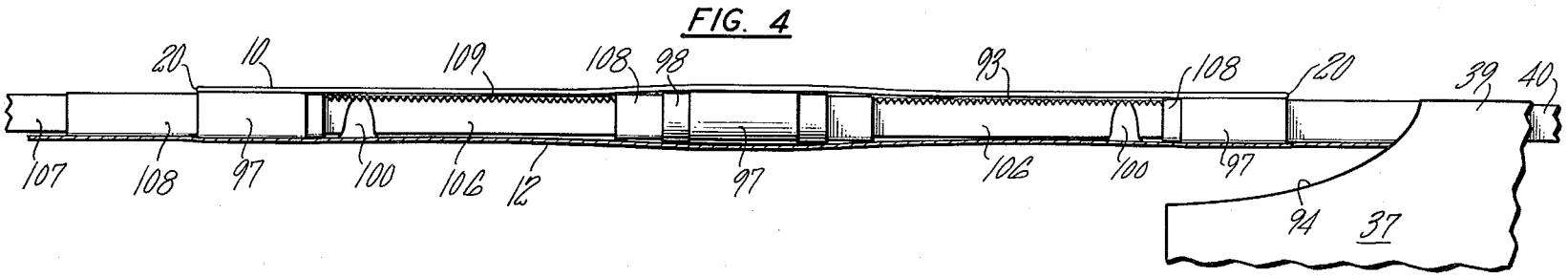
FIG. 4 is an enlarged partial transverse elevation section view, partly broken away and partly in section, showing a tranverse separator bar assembly of the detacher.

Referring particularly to FIGS. 2 and 3, the transverse bar 40 extends parallel to the axis of the feed rolls 50, 52 and is located slightly rearwardly of the throat 74 of the feed rolls 50, 52. The bar 40 is vertically positioned on the pair of upstanding support fasteners 79 so that its upper flat guide surface 93 lies in a plane slightly below a normal feed plane through the feed rolls 50, 52 and so that the envelopes feed generally directly across the top guide surface 93 of the bar 40 into the throat 74. The entry tracks 36, 37 are mounted on the transverse bar 40 to provide a generally flat upwardly inclined ramp to the normal feed plane through the feed rolls 50, 52 and so that the envelopes are smoothly fed in succession, first up the ramp provided by the guide tracks 36, 37 and then across the upper guide surface 93 of the transverse bar 40 to the feed rolls 50, 52. The inner laterally spaced parallel edges 43, 44 of the entry guide tracks 36, 37 terminate at forward recessed edge portions 94 so that the leading edge of each envelope 10 passes from the entry guide tracks 36, 37 across a short gap or span of about one inch to the upper guide surface 93 of the transverse bar 40. The envelope rigidity is adequate to carry its lower or leading edge 95 from the entry guide tracks 36, 37 over that short span and to the upper guide surface 93.

As explained, the carrier sheet 12 is threaded through the detacher 30 to pass below the transverse bar 40 and then between the feed rolls 50, 52. The feed rolls 50, 52 are then driven to feed the composite envelope and carrier sheet product 23 and, after separation, the separated carrier sheet and envelopes through the detacher 30. The separated envelopes 10 are caught and collected by the collector 57 at the forward end of the detacher 30 and three laterally spaced and longitudinally extending flexible guide tapes 97 are mounted between the transverse bars 40, 64 to assist in guiding the carrier sheet 12 from under the bar 40 through the feed rolls 50, 52 and downwardly beneath the forward transverse bar 64. All three flexible guide tapes 97 also assist in feeding the envelopes 10 through the feed rolls 50, 52. One of the three flexible guide tapes 97 is centrally located laterally between the narrow backup rolls 52, and the remaining two flexible guide tapes 97 are positioned laterally outwardly of the backup rolls 52. The forward ends of the flexible guide tapes 97 are suitably adhered to the underside and forward edge of the forward transverse bar 64. The rear ends of the two outer flexible guide tapes 97 are suitably adhered to the upper surface of a pair of retaining clips 108 for a blade 106 hereinafter described, whereas the rear end of the middle guide tape 97 is suitably adhered to the outer convex surface of a central U-shaped guide 98. The guide 98 provides a rounded leading edge for the bar 40 for smoothly guiding the envelopes 10 over the bar 40 and the carrier sheet 12 under the bar 40.

A separator formed by the transverse bar 40, rounded guide 98, flexible tapes 97, blade 106 and its retaining clips 108, functions to separate the carrier sheet 12 from the envelopes 10 as they are conveyed up the ramp provided by the entry tracks 36, 37 and so that the angle of separation of the "floating" carrier sheet 12 is relatively small and variable and primarily dependent on the tear strength of the spot attachments 14, 15 and tautness of the carrier sheet (the latter being primarily a function of the drag on the envelopes 10 and carrier sheet 12 by the entry tracks 36, 37 and, it has been found, relatively independent of the rate of feed of the composite product 23 through the detacher 30).

Figure 5:
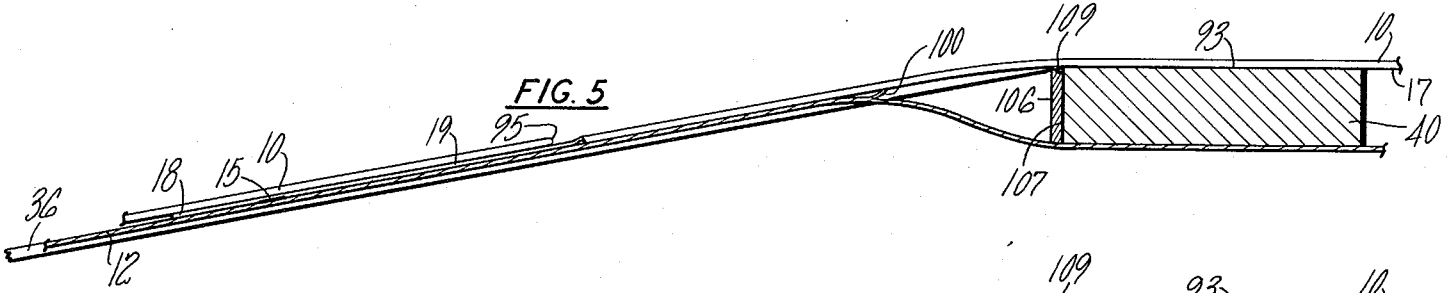
FIGS. 5–7 are enlarged partial longitudinal elevation section views, partly broken away and partly in section, showing three different envelope/carrier sheet separation phases of the continuous envelope system.
Figure 6:
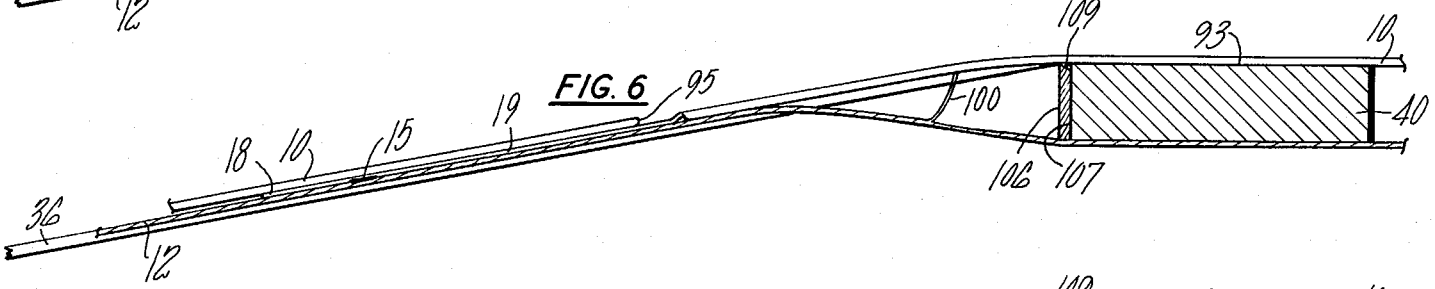
Figure 7:
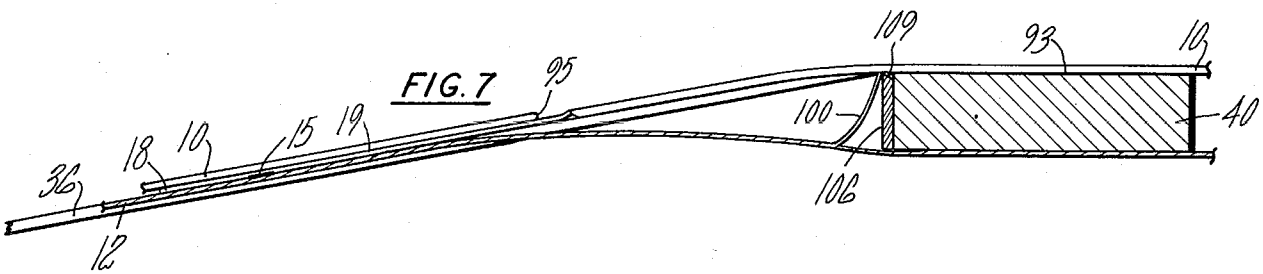

Referring specifically to FIGS. 5–7, as the carrier sheet 12 is separated or withdrawn from each envelope 10, superficial or surface connector tears or delaminations 100 from the paper surface of the envelope 10 and/or carrier sheet 12 are caused at the spot attachments 14, 15 to form connector tears or delaminations 100 between the separated envelope and carrier sheet. If a surface tear connector 100 tears or delaminates from the envelope only, it will quickly reach and separate from the adjacent trailing edge 16, 18 of the envelope back panel 17 or sealing flap 19 respectively as the case may be. In that event, the surface tear connector 100 is withdrawn off the edge of the envelope paper without leaving any residual connector portion attached to the envelope and with a minimum superficial or surface tear blemish on the inside surface of the envelope sealing flap 19 or back panel 17 as the case may be. In either case, such a slight surface blemish is completely hidden when the envelope is sealed.

If the surface tear connector 100 tears from only the carrier sheet 12 or from both the carrier sheet 12 and envelope, the surface tear connector 100 continues to lengthen under the tension of the continuing separation of the carrier sheet 12 until the tear connector 100 reaches substantially the leading edge of the transverse bar 40.

The flat blade 106 is held flush against the flat leading edge 107 of the transverse bar 40 with the three metal retaining clips 108, and with the uncovered portion of the toothed cutting or severance edge 109 of the blade 106 adjacent to and substantially in the plane of the upper guide surface 93 of the transverse bar 40 and in laternal alignment with the tear connectors 100. The toothed blade edge 109 is preferably formed as a saw blade edge and such that the blade 106 can for example be a conventional hack saw blade, as shown. The saw teeth of the toothed blade edge 109 preferably project toward the overlying envelopes and so that they engage, grip and then sever each remaining tear connector 100 as the envelope is conveyed over the blade 106, thus removing the tear connector 100 from the envelope and at the envelope, without, it has been found, further tearing the envelope. As a result, there remains only a spot blemish on the envelope after the tear connector 100 is severed and removed, and the spot blemish, whether on the sealing flap 19 or on the envelope back panel 17 is completely hidden when the envelope is sealed.

The severance action of the blade 106 is enhanced by the tautness of the tear connector 100 as it engages the toothed blade edge 109, since such tautness causes the blade teeth to effectively grip the tear connector 100 immediately adjacent the envelope to sever the tear connector 100 from the envelope. Thus, as the tear connectors 100 are preferably maintained taut by the separating carrier sheet 12 until after the tear connectors 100 are severed from the envelope, the carrier sheet 12 is preferably not perforated or otherwise weakened immediately rearwardly of the attachment spots 14, 15 (as in some prior art continuous envelope systems) to assure that the tear connectors 100 remain firmly attached to the carrier sheet and under tension by the carrier sheet 12.

The distance between the blade edge 109 and the line of engagement of the feed rolls 50, 52, for example is approximately 1½ inch, and in any case, is substantially less than the distance between the lower or leading edge 95 of the envelope 10 and the leading attachment spots 14 on the envelope back panel 17, and such that the feed rolls 50, 52 are effective in pulling each envelope 10 as each tear connector 100 is severed from the envelope by the blade 106. Thus, each envelope is also under tension and is being positively fed by the feed rolls 50, 52 as each tear connector 100 is severed, thereby assisting in effecting a clean severance of the envelope from each tear connector 100. In addition, as the feed rolls 50, 52 provide for feeding the carrier sheet 12 at the same rate as the envelopes, the separating and tearing action is effected smoothly and with a separating and tearing force which varies with the angle of separation of the carrier sheet and envelope. The angle of separation is automatically adjusted in accordance with the strength of each attachment spot and the tear strength of the paper and the envelope is free to bow downwardly immediately rearwardly of the blade 106 and the carrier sheet is free to bow upwardly and such that the separating and tearing action is automatically and continually controlled up to the point of severance of each tear connector.

As will be apparent to persons skilled in the art various modifications, adaptations and variations of the foregoing specific disclosure can be made without departing from the teachings of the present invention.

I claim:

1. In a continuous envelope system for attaching envelopes in succession to an elongated paper carrier sheet and subsequently detaching the envelopes from the carrier sheet, the envelopes having a transversely extending envelope body with a front panel and a back panel with an upper transverse edge defining an envelope opening and an upper sealing flap with an upper transverse edge and a lower transversely extending fold connector to the front panel providing for folding the sealing flap rearwardly and downwardly into sealing engagement with the back panel to seal the envelope, the continuous envelope means comprising the steps of attaching the envelopes in longitudinal succession to the carrier sheet to form an elongated composite envelope and carrier sheet product, with each envelope extending transversely of the elongated carrier sheet, the sealing flap open and lying beneath the body of the succeeding envelope and the sealing flap and back panel in engagement with the carrier sheet, with attachment spots between each envelope and the carrier sheet at the sealing flap and the back panel, and subsequently detaching the envelopes in succession by longitudinally conveying the elongated composite envelope and carrier sheet product forwardly with the envelope sealing flaps trailing the envelope body, and gradually separating the envelopes and carrier sheet as they are being longitudinally forward conveyed to form from the attachment spots surface tear connectors between the carrier sheet and envelopes, and severing, with severance means provided between the gradually separating envelopes and carrier sheet, the tear connectors interconnecting each envelope and carrier sheet adjacent the envelope to remove the tear connectors from the envelope as the carrier sheet and envelope are being conveyed longitudinally forwardly and gradually separated.

2. The continuous envelope system of claim 1 wherein the envelopes are attached to the carrier sheet with attachment spots at unweakened areas of the elongated carrier sheet so that the carrier sheet maintains the interconnecting tear connectors in tension, as they are severed, by the gradual separation of the carrier sheet and envelopes.

3. In a continuous envelope system for attaching envelopes in succession to an elongated paper carrier sheet and subsequently detaching the envelopes from the carrier sheet, the envelopes having a transversely extending envelope body with a front panel and a back panel with an upper transverse edge defining an envelope opening and an upper sealing flap with an upper transverse edge and a lower transversely extending fold connector to the front panel providing for folding the sealing flap rearwardly and downwardly into sealing engagement with the back panel to seal the envelope, the continuous envelope system comprising the steps of attaching the envelopes in longitudinal succession to the carrier sheet to form an elongated composite envelope and carrier sheet product, with each envelope extending transversely of the elongated carrier sheet, the sealing flap open and lying beneath the body of the succeeding envelope and the sealing flap and back panel in engagement with the carrier sheet, with attachment spots between each envelope and the carrier sheet at the sealing flap and the back panel, and subsequently detaching the envelopes in successionn by longitudinally conveying the elongated composite envelope and carrier sheet product forwardly with the envelope sealing flaps trailing the envelope body, and gradually separating the envelopes and carrier sheet as they are being longitudinally forwardly conveyed to form from the attachment spots surface tear connectors between the carrier sheet and envelopes, and severing the tear connectors interconnecting each envelope and carrier sheet adjacent the envelope to remove the tear connectors from the envelope as the carrier sheet and envelope are being conveyed longitudinally forwardly and gradually separated, the separation step being provided by supporting the composite envelope and carrier sheet product on flat thin track means received between the envelope and carrier sheet and separating the carrier sheet from the track means.

4. The continuous envelope system of claim 3 wherein the carrier sheet is separated from the track means by withdrawing the carrier sheet from the track means by withdrawing the carrier sheet from the track means so as to permit its rate of separation to be determined in part by the tension of the interconnecting tear connectors.

5. A method for detaching the paper articles from an elongated paper carrier sheet to which the paper articles are attached in longitudinal succession at individual attachment spots of the paper articles and carrier sheet to form an elongated composite product for use in processing the paper articles, comprising the steps of conveying the elongated composite product longitudinally forwardly, and separating the paper articles and carrier sheet as they are being longitudinally forwardly conveyed to form, from the attachment spots, surface tear connectors between the paper carrier sheet and paper articles, and severing, with severance means provided between the separating paper articles and carrier sheet, the tear connectors interconnecting the paper carrier sheet and paper articles immediately adjacent the paper articles to detach the paper articles from the carrier sheet as the carrier sheet and paper articles are being conveyed longitudinally forwardly.

6. A paper article detachment method according to claim 5 wherein the interconnecting tear connectors are severed immediately adjacent the paper articles with the interconnecting tear connectors under tension.

7. A method for detaching the paper articles from an elongated paper carrier sheet to which the paper articles are attached in longitudinal succession at individual attachment spots of the paper articles and carrier sheet to form an elongated composite product for use in processing the paper articles, comprising the steps of conveying the elongated composite product longitudinally forwardly, and separating the paper articles and carrier sheet as they are being longitudinally forwardly conveyed to form, from the attachment spots, surface tear connectors between the paper carrier sheet and paper articles, and severing the tear connectors interconnecting the paper carrier sheet and paper articles immediately adjacent the paper articles to detach the paper articles from the carrier sheet as the carrier sheet and paper articles are being conveyed longitudinally forwardly, the separation step being provided by gradually separating the paper articles and carrier sheet at an acute angle as they are being longitudinally forwardly conveyed and the interconnecting tear connectors being severed to detach the paper articles from the carrier sheet as the paper articles and carrier sheet are being gradually separated and the interconnecting tear connectors are thereby maintained in tension.

8. A method for detaching the paper articles from an elongated paper carrier sheet to which the paper articles are attached in longitudinal succession at individual attachment spots of the paper articles and carrier sheet to form an elongated compositie product for use in processing the paper articles, comprising the steps of conveying the elongated composite product longitudinally forwardly, and separating the paper articles and carrier sheet as they are being longitudinally forwardly conveyed to form, from the attachment spots, surface tear connectors between the paper carrier sheet and paper articles, and severing the tear connectors interconnecting the paper carrier sheet and paper articles immediately adjacent the paper articles to detach the paper articles from the carrier sheet as the carrier sheet and paper articles are being conveyed longitudinally forwardly, the severing step being provided by severing the interconnecting tear connectors immediately adjacent the paper articles with the interconnecting tear connectors under tension and by a toothed edge which grips the tensioned interconnecting tear connectors adjacent the paper articles to sever them from the paper articles as the paper articles are forwardly conveyed therefrom.

9. A method for detaching the paper articles from an elongated paper carrier sheet to which the paper articles are attached in longitudinal succession at individual attachment spots of the paper articles and carrier sheet to form an elongated composite product for use in processing the paper articles, comprising the steps of conveying the elongated composite product longitudinally forwardly, and separating the paper articles and carrier sheet as they are being longitudinally forwardly conveyed to form, from the attachment spots, surface tear connectors between the paper carrier sheet and paper articles, and severing the tear connectors interconnecting the paper carrier sheet and paper articles immediately adjacent the paper articles to detach the paper articles from the carrier sheet as the carrier sheet and paper articles are being conveyed longitudinally forwardly, the interconnecting tear connectors being severed by a toothed edge which grips the interconnecting tear connectors immediately adjacent the paper articles with the interconnecting tear connectors under tension to sever them as the paper articles are forwardly conveyed therefrom, and the paper articles being forwardly conveyed to place the forward portion of each paper article under tension as the tear connectors interconnecting the paper articles to the carrier sheet are severed.

10. Detaching apparatus for forwardly longitudinally conveying and detaching paper envelopes and the like paper articles from a paper carrier sheet to which the paper articles are attached in longitudinal succession at individual attachment spots inwardly of the lateral edges of the paper articles of carrier sheet to form an elongated composite product for use in processing the paper articles in succession, the detaching apparatus comprising a frame, a pair of laterally spaced generally coplanar flat tracks mounted on the frame for receipt between the carrier sheet and lateral ends of the paper articles, feed means forwardly of the laterally spaced tracks for receiving the carrier sheet and paper articles and operable for forwardly feeding the composite product and separated paper articles and carrier sheet, and a separator intermediate the entry tracks and feed means providing for conveying the paper articles in succession on one side thereof and the carrier sheet on the other side thereof and thereby separate the carrier sheet from the paper articles in succession, the separator being oriented relative to the feed means and entry tracks to provide gradual separation of the carrier sheet from the paper articles in succession to form tear connectors therebetween from the spot attachments, the separator having a severance blade edge at the rear leading edge thereof and adjacent said one side thereof for shearing the tear connectors, connecting a paper article to the carrier sheet, at the paper article as the paper article is conveyed on one side of the separtor past the severance blade edge.

11. Detaching apparatus according to claim 10 wherein the feed means comprises engaging drive and backup rolls for receiving the paper articles and carrier sheet therebetween for conveying the carrier sheet and paper articles at the same rate.

12. Detaching apparatus according to claim 10 wherein the feed means is positioned for engaging and forwardly pulling the paper articles in succession past said blade edge to place the forward portion of each paper article under tension as its interconnecting tear connectors are severed by the blade edge.

13. Detaching apparatus according to claim 10 wherein the entry tracks provide an inclined ramp for conveying the paper articles along an inclined path to the blade edge and wherein the separator is oriented to withdraw the carrier sheet from the entry tracks at an acute angle and with the carrier sheet unsupported between its point of withdrawal from the tracks and the separator and whereby the paper carrier sheet is adapted to maintain the interconnecting connector tears in tension at the blade edge for severing the interconnecting tear connectors immediately adjacent the envelopes.

14. Detaching apparatus according to claim 10 further comprising paper article collector forwardly of the feed means for collecting the detached paper articles as they are fed therefrom, the collector means comprising a lower envelope support for supporting the collected paper articles and an overlying envelope retainer pivotally mounted for pivotal movement about a laterally extending axis and extending forwardly from the feed means for engagement by the paper articles as they are conveyed forwardly therefrom to the collector support.

15. Detaching apparatus according to claim 10 wherein the blade edge is a toothed edge which is generally normal to the path of the paper articles.

16. In a continuous envelope system for attaching envelopes in succession to an elongated paper carrier sheet and subsequently detaching the envelopes from the carrier sheet, the continuous envelope system comprising the steps of attaching the envelopes in longitudinal succession to the carrier sheet to form an elongated composite envelope and carrier sheet product with attachment spots between each envelope and the carrier sheet at unweakened areas of the elongated carrier sheet, and subsequently detaching the envelopes in succession by longitudinally conveying the elongated composite envelope and carrier sheet produce forwardly and gradually separating the envelopes and carrier sheet as they are being longitudinally forwardly conveyed to form from the attachment spots surface tear connectors between the carrier sheet and envelopes, and severing, with severance means provided between the gradually separating envelopes and carrier sheet, each tear connector interconnecting each envelope and carrier sheet adjacent the envelope and with the tear connector in tension between the envelope and carrier sheet to remove the tear connector from the envelope.

* * * * *

UNITED STATES PATENT OFFICE
CERTIFICATE OF CORRECTION

Patent No. 3,980,006 Dated September 14, 1976

Inventor(s) Archibald H. Welch

It is certified that error appears in the above-identified patent and that said Letters Patent are hereby corrected as shown below:

Column 1, line 33, wherein the word "carirer" should be --carrier--;

Column 4, line 48, wherein "51" should be --52--;

Column 7, line 19, wherein the word "laternal" should be --lateral--;

Column 8, line 24, wherein the word "means" should be --system--;

Column 8, line 39, wherein the word "forward" should be --forwardly--;

Column 9, line 9, wherein the word "successionn" should be --succession--;

Column 9, line 29, delete the entire line;

Column 11, line 22, wherein the word "separtor" should be --separator--;

UNITED STATES PATENT OFFICE
CERTIFICATE OF CORRECTION

Patent No. 3,980,006 Dated September 14, 1976

Inventor(s) Archibald H. Welch

It is certified that error appears in the above-identified patent and that said Letters Patent are hereby corrected as shown below:

Column 12, line 30, wherein the word "produce" should be --product--.

Signed and Sealed this

Fourth Day of April 1978

[SEAL]

Attest:

RUTH C. MASON
Attesting Officer

LUTRELLE F. PARKER
Acting Commissioner of Patents and Trademarks